US006427367B1

(12) United States Patent
Phillips

(10) Patent No.: US 6,427,367 B1
(45) Date of Patent: Aug. 6, 2002

(54) MEMORIAL CROSS MARKER

(76) Inventor: Garland Phillips, 561 28 Rd., Grand Junction, CO (US) 81501

( * ) Notice: Subject to any disclaimer, the term of this patent is extended or adjusted under 35 U.S.C. 154(b) by 0 days.

(21) Appl. No.: 09/458,158

(22) Filed: Dec. 9, 1999

(51) Int. Cl.[7] ..... G09F 19/00; B25G 3/00
(52) U.S. Cl. ..... 40/124.5; 403/230
(58) Field of Search ..... 40/124.5; 403/230, 403/241; 256/65, 59

(56) References Cited

U.S. PATENT DOCUMENTS

| | | | | | |
|---|---|---|---|---|---|
| 1,257,147 | A | | 3/1918 | Sargent | |
| 1,364,902 | A | | 1/1921 | Sullivan | |
| 1,400,970 | A | | 12/1921 | Norman | |
| 1,526,381 | A | | 2/1925 | Slawson | |
| 1,571,350 | A | * | 2/1926 | Washburn | 256/65 |
| 1,612,357 | A | | 12/1926 | Brown | |
| 2,164,547 | A | * | 7/1939 | Smith | 47/41 |
| 2,917,853 | A | | 12/1959 | Lawski | |
| 3,822,053 | A | * | 7/1974 | Daily | 256/21 |
| 3,977,110 | A | | 8/1976 | Yerger | |
| 4,058,929 | A | * | 11/1977 | O'Connell | 47/41.12 |
| 4,898,365 | A | * | 2/1990 | Conner et al. | 256/65 |
| 5,454,548 | A | * | 10/1995 | Moore | 256/22 |
| 5,660,378 | A | * | 8/1997 | Schall | 256/65 |
| 5,882,001 | A | * | 3/1999 | Reinbold | 256/22 |

* cited by examiner

*Primary Examiner*—Lynne H. Browne
*Assistant Examiner*—Kenn Thompson
(74) *Attorney, Agent, or Firm*—Ramon L. Pizarro; Edwin H. Crabtree

(57) ABSTRACT

A cross shaped marker that includes an elongated vertical member having an aperture near one of the ends of the vertical member. The aperture extending through the elongated vertical member. The aperture further having an engagement mechanism for securing a member inserted through the aperture. An elongated horizontal member having sides and an index engagement mechanism for cooperating with the engagement mechanism on the elongated vertical member, so that on insertion of the horizontal member through the aperture in the vertical member, the index engagement mechanism of the horizontal member cooperates with the engagement mechanism of the vertical member to fix the position of the horizontal member through the aperture in the vertical member to form the cross shaped marker.

18 Claims, 2 Drawing Sheets

MEMORIAL CROSS MARKER

BACKGROUND OF THE INVENTION (a) Field of the Invention

This invention generally relates to a Christian cross marker for use as a marker memorializing the location of the loss of a loved one along a road. More particularly, but not by way of limitation, to a novel method and structure for assembly of a cross shaped marker.

(b) Discussion of Known Art

The use of cross shaped markers to indicate the location of the loss of a loved one, or another significant Christian event or location, is a long established Christian tradition. The formation or assembly of the crosses used as markers varies with the financial resources of the user and the location to be marked. Grave sites, for example, are often marked with crosses made of stone, such as granite or marble, for example. The cost of creating these markers makes the use of such markers impracticable in applications where it is contemplated that the marker is to remain for a relatively short period of time.

The use of a temporary, inexpensive, cross shaped marker has been explored by previous artisans, resulting in a variety of known devices. One such device is shown in U.S. Pat. No. 1,258,147 to Sargent. The Sargent device provides the structure needed for forming a cross out of a vertical member and a horizontal member. Both the vertical member as well as the horizontal member of the Sargent device are formed from channel sections, which leave an open back portion of the cross. Additionally, the horizontal member of the Sargent device includes a recessed section that forms a seat that accommodates the vertical member. The seat also includes a pair of slots that accepts a pair of bendable tabs that are fitted into the slots, and later bent against the horizontal member to hold the horizontal member against the vertical member. The Sargent device provides the end result of forming a cross, but leaves important unanswered needs. One such need is the need to serve as an easy to assemble cross that does not depend greatly on user skill for its assembly.

While the Sargent device appears to require little skill to assemble, it is foreseeable that insufficient blending or pressure of the tabs from the vertical members against the horizontal member will produce a loose support of the horizontal member against the vertical member. The tabs may be straightened and re-bent to produce a tight fit, but this process can only be repeated a few times before the tabs break off due to metal fatigue.

Another known device is discussed in U.S. Pat. No. 1,364,902 to Sullivan, which teaches a fixed cross with means for supporting a display sign on the cross. This structure is similar to the structure taught in U.S. Pat. No. 1,400,970 to Norman, which teaches a fastened assembly made from channel sections that resemble the channel sections of the Sargent invention. A significant drawback of using channel sections is the fact that these result in a cross with a front portion which is suitable for display as a memorial marker, and a back with exposed, unsightly components of the connection mechanism used to retain the horizontal member against the vertical member. Other known devices which also suffer from this limitation is disclosed in U.S. Pat. No. 1,526,381 to Slawson and U.S. Pat. No. 1,612,357 to Brown.

Thus, a review of known devices reveals that there remains a need for a simple device for forming a cross shaped ornament that produces an aesthetically pleasing and similar image from when viewed from the front or back.

Furthermore, there remains a need for a system that allows a user to assemble a simple cross shaped ornament while using very little assembly skill to produce a consistently aesthetically pleasing product.

Still further, there remains a need for a simple weather resistant roadside marker or ornament that can be easily shipped or mailed unassembled in a compact manner.

There remains a need for an easy to assemble cross-shaped roadside marker that can be manufactured inexpensively, and produce a finished product when assembled.

SUMMARY

It has been discovered that the problems left unanswered by known art can be solved by providing a road side cross that includes:

a hollow vertical member having sides, two opposing sides having each having apertures that are opposite to one another, at least one of the apertures includes a resilient or rigid projection; and a hollow elongated horizontal member that includes resilient sides, the sides having a perimeter that approximately coincides with the shape of the apertures in the sides of the hollow vertical member, and the sides further having an aperture adapted for accepting the projection in the hollow vertical member.

According to a highly preferred embodiment of the invention the hollow vertical member includes a longitudinal axis. Additionally, according to this exemplar embodiment, the vertical member includes a hollow, generally rectangular, cross-section normal to the longitudinal axis of the vertical member. Additionally, in this example, the apertures in the sides of the of the vertical member are planar, and are parallel and opposite to one another on the sides of the vertical member. Thus, this arrangement produces a pair of apertures that allow insertion and support of the horizontal member to form the cross shape for the memorial marker.

It is further contemplated that both the vertical member as well as the horizontal member will terminate in hollow ends which are closed or covered with the use of end-caps. Use of the marker as a cross will require that only one of the ends of the vertical member be covered. This is because one of the ends of the vertical marker will be buried or attached to a buried support used to hold the cross in an upright position.

It is also contemplated that the horizontal member as well as the vertical member will be made from a plastic section of material, such as a section of PVC (polyvinyl chloride) extrusion having a generally rectangular cross-section. The PVC extrusion would be cut to create a horizontal member of a length and a vertical member of a length that is longer than the horizontal member. The area encompassed by the cross section of the horizontal member would preferably be less than the cross sectional area of the vertical member. Two opposing sides of the vertical member will include the openings for accepting the horizontal member. The two openings will include centers that will be on a line that is normal to the longitudinal axis of the vertical member. Of course, at least one of the openings will include the locking tab which will cooperate with the aperture on the side of the horizontal member to secure this member at a desired location through the vertical member.

It has been discovered that by making the horizontal member of a size that is smaller than the hollow vertical member, one achieves a system that provides efficiencies in transport and storage. Importantly, the larger hollow vertical member can store the horizontal member for shipping. The end user would then remove the horizontal member and insert it through the opening in the vertical member until the locking tab or protrusion along the horizontal member engages the slot in the horizontal member.

It is also important to note that it is contemplated that the horizontal member may be hollow while the vertical member may be solid. Of course it is also contemplated that both the n horizontal as well as the vertical member may be solid, but this would eliminate the advantage of having the horizontal member nest within the vertical member for shipping.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
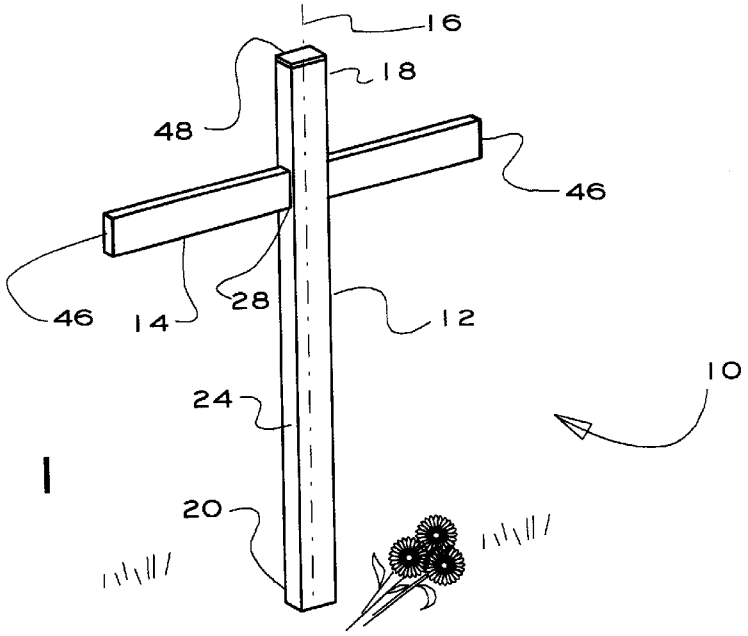
FIG. 1 is a perspective view of an embodiment of the invention as used to form a road side memorial marker.

Turning now to FIG. 1 where a cross shaped marker 10 is shown as used as a roadside memorial marker, indicating where a traffic accident has occurred. As illustrated in FIG. 1, the disclosed invention produces a cross shaped marker that provides the visual impression of a marker that has been carved from stone or made from other materials that result in a structure that does not include an overlapping or stacked arrangement of the horizontal member over the vertical member. In other words, the structure results in a cross where the horizontal members or arms extend from the vertical member.

Thus, as illustrated in FIG. 1, a preferred example of the marker 10 includes a vertical member 12, which is preferably hollow, and a horizontal member 14, which is also preferably hollow. In this highly preferred embodiment of the invention, the horizontal member 14 extends through the vertical member 12. However, it is important to note that it is contemplated that the principles and structure taught herein could also be used to create a device where the vertical member extends through the horizontal member.

Figure 2:
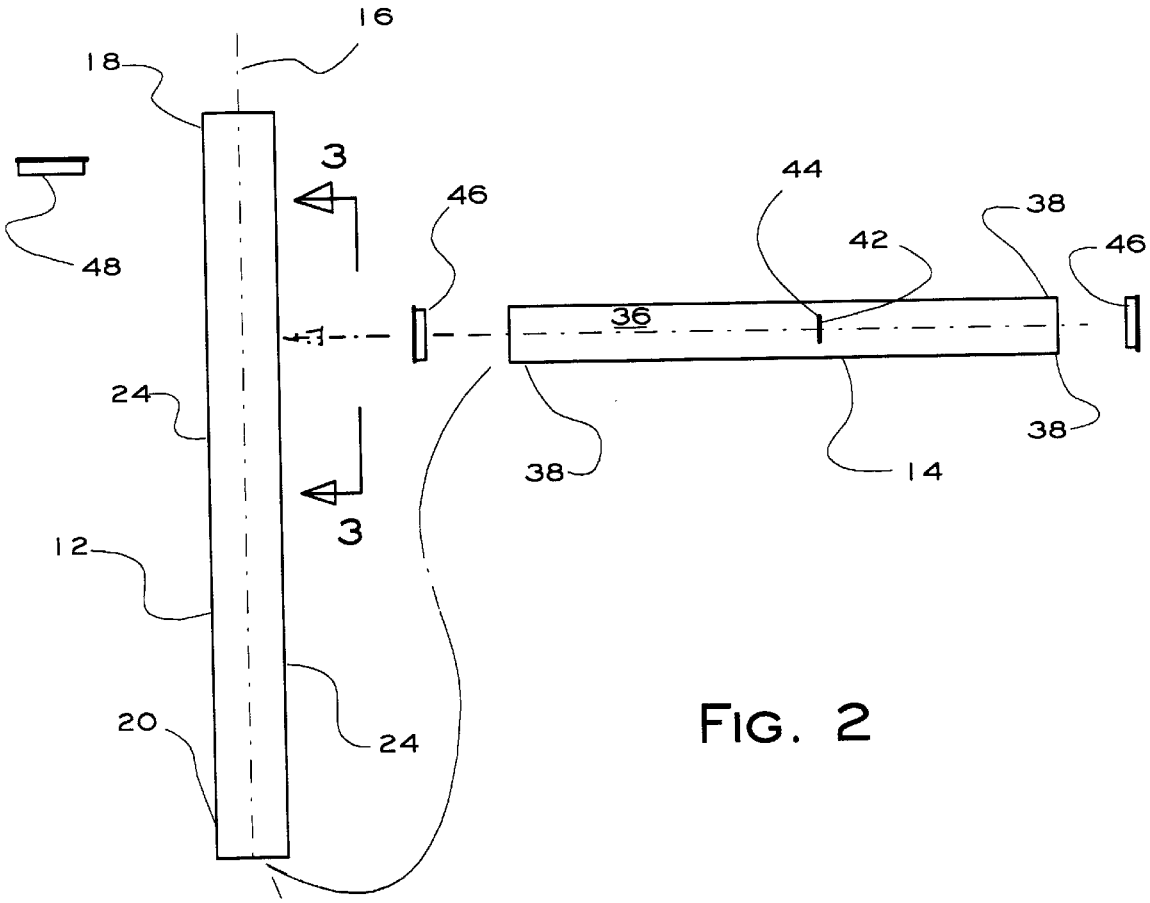
FIG. 2 illustrates an example of the major components of the disclosed invention and indicates the ability of storing the horizontal member with the vertical member for shipping.

The components illustrated in FIG. 2 show that according to a highly preferred embodiment of the invention, the horizontal member 14 is made from a plastic extrusion, such as a poly vinyl chloride (PVC) material, and the vertical member 12 is made from similarly manufactured extrusion of a plastic material. Additionally, a pair of optional end caps have been provided for placement or insertion into the ends 38 of the horizontal member 14, and a single optional end cap 15 has been provided for placement over one of the ends 20 of the vertical member 12.

Figure 4:
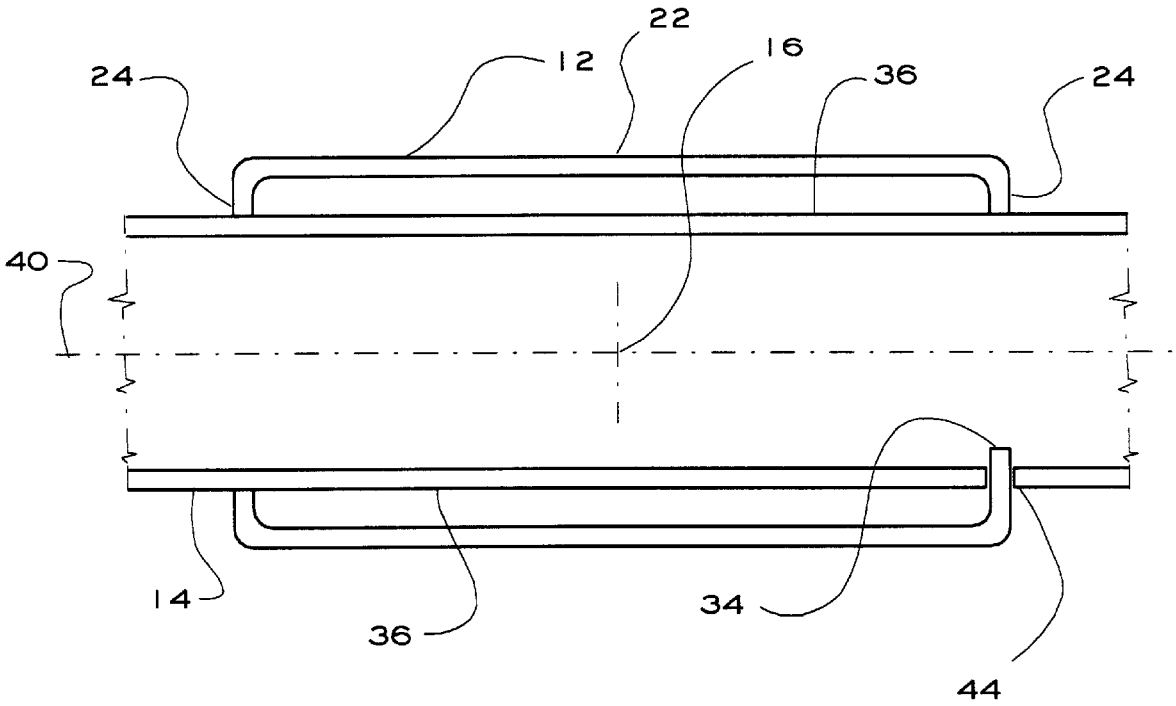
FIG. 4 is a view taken from FIG. 3 as indicated by the arrows on FIG. 3, and further illustrates a preferred example of the structure used in producing a connection between the horizontal member and the vertical member.

Referring now to FIGS. 2 and 4, it will be understood that according to a highly preferred example of the invention, the vertical member 12 is hollow and elongated in shape. Moreover, the vertical member 12 has a major axis 16, as well as a first end 18 and a second end 20. It is preferred that the vertical member 12 will include a generally rectangular cross section 22, normal to the major axis 16, as illustrated in FIG. 4.

Also illustrated in FIG. 4 is that rectangular cross section 22 of the vertical member 12 will include generally planar sides 24 that are parallel to one another. Thus, the sides 24 are parallel and separated from one another and the major axis 16. Thus, the major axis 16 extends between the ends, 18 and 20, throughout the length of the vertical member 12.

Figure 3:
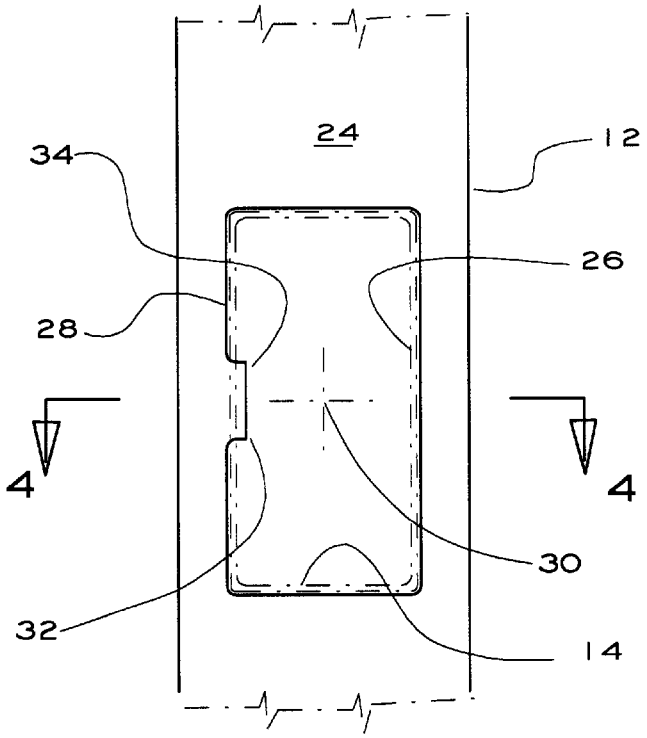
FIG. 3 is a view taken from FIG. 2 as indicated by the arrows on FIG. 2, and illustrates a preferred example of the structure used in producing a connection between the horizontal member and the vertical member.

Turning now to FIGS. 2 and 3, it will be understood that the horizontal member 14 will have a cross section 26, which in the preferred example has a generally rectangular cross section. As shown in FIG. 3, the sides 24 of the vertical member 12 will preferably include an aperture 28 with a cross section that approximately coincides with the cross section 26 of the horizontal member 14. The aperture 28 will preferably extend through the elongated vertical member 12, through the two opposing sides 24 of the vertical member 12. The aperture 28 will include a central axis 30 that is normal to the major axis 16 of the elongated vertical member 12. Preferably, the aperture 28 will be closer to the first end 18 of the vertical member 12 than the second end 20 of the vertical member 12.

FIG. 3 illustrates that the aperture 28 will include an engagement means 32 for securing a member, such as the horizontal member 14, inserted through the aperture 28. In a highly preferred embodiment of the invention, this engagement means 32 consists of a male portion 34 that extends from the aperture 28 in the vertical member 12. In the illustrated embodiment, the male portion 34 is of unitary construction with the vertical member 12.

Examining FIGS. 2 and 4, it will become apparent that a preferred example of the horizontal member 14 will include sides 36 that are spaced apart in a generally parallel manner, and a pair of ends 38. The ends 38 of the horizontal member 14 should lie along a central axis 40 within the horizontal member 14, and be spaced apart from one another at a distance that is greater than the distance between the sides 24 of the vertical member 12. Also illustrated in FIGS. 2 and 3 is that at least one of the sides 36 of the horizontal member 14 will include an index engagement means 42 for cooperating with the engagement means 32 on the elongated vertical member 12. Preferably, the index engagement means 42 of the horizontal member 14 will be closer to one of the ends 38 of the horizontal member 14 than the opposite end 38 of the horizontal member 14. This structure will allow insertion of the horizontal member 14 through the aperture 28 in the vertical member 12, and result in the cooperation of the index engagement means 42 of the horizontal member 14 with the engagement means 32 of the vertical member 12 to fix the position of the horizontal member 14 through the vertical member 12 to form the cross shaped marker 10.

Thus, according to a highly preferred embodiment of the invention, the sides 36 of the horizontal member 14 are resilient, flexible. Furthermore, the index engagement means 42 on one of the sides 36 of the horizontal member 14 will be a slot shaped aperture 44 that will accept the engagement means 32, or male portion 34, on the vertical member 12. Accordingly, upon insertion of the horizontal member 14 through the aperture 28 in the vertical member 12 causes the male portion 34 on the vertical member 12 to deflect the side 36 of the horizontal member 14 to permit the horizontal member 14 to slide through the aperture 28 in the vertical member 12 until the male portion 34 is accepted into and engages the slotted aperture 44 in the horizontal member 14. Upon acceptance of the male portion 34, the resiliency of the sides 36 of the horizontal member 14 will bias or urge the slotted aperture 44 towards the male portion 34.

In use, the invention could conveniently be stored and sold from a centralized location, and shipped to buyers, such as mortuaries, flower shops, churches, individuals, and so on. It is contemplated that the marker 10 would be shipped with the horizontal member 14 stored within the vertical member 12, and the end covers 46 of the horizontal member, as well as the end cap 48 of the vertical member. The user would then separate the two members and insert the horizontal member 14 through the aperture 28 in the vertical member 12. The insertion of the horizontal member 14 should be carried out such that the slot shaped aperture 44 in the horizontal member 14 aligns with the male portion 34 in the vertical member 12, so that the male portion 34 may cooperate with the slot shaped aperture 44 to fix the horizontal member 14 relative to the vertical member 12 as shown in FIG. 1 and FIG. 4. As explained above, it is preferred that the slot 44 will be closer to one end of the horizontal member 14 so as to result in a symmetrical cross when the male portion 34 engages the slot 44.

As discussed above, it is preferred that the resiliency of the horizontal member 14 provide the needed flex to allow the male portion 34 to be formed as a protrusion of unitary construction with the vertical member 12. Therefore, it is contemplated that the vertical member may be made from a rigid, even solid, single unit with the aperture 28 therethrough. Also, it is contemplated that the male portion 34 may be designed with resiliency to bias the male portion towards the slot 44, allowing the horizontal member to be manufactured from a rigid material.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A cross shaped marker comprising:

an elongated vertical member having a major axis, ends and at least two opposing sides separated by a distance, the major axis extending between the ends, the major axis being longer than the distance between the two opposing sides, the elongated vertical member further having an aperture extending through the elongated vertical member and between the two opposing sides, the aperture having a central axis that is normal to the major axis of the elongated vertical member, the aperture further having engagement means for securing a member inserted through the aperture;

an elongated horizontal member entirely supported by said elongated vertical member, the elongated horizontal member having sides that are spaced apart and a pair of ends along a central axis, the ends of the elongated horizontal member being spaced apart at a distance that is greater than the distance between the sides of the elongated horizontal member, one of the sides of the elongated horizontal member having an index engagement means for cooperating with the engagement means on the elongated vertical member, the index engagement means for cooperating with the engagement means on the elongated vertical member being at approximately mid-span along the elongated horizontal member, so that on insertion of the horizontal member through the aperture in the vertical member, the index engagement means of the horizontal member cooperates with the engagement means on the vertical member to fix the position of the horizontal member through the vertical member to form the cross shaped marker with the elongated vertical member bisecting the elongated horizontal member.

2. A cross shaped marker according to claim 1 wherein said elongated vertical member is hollow.

3. A cross shaped marker according to claim 1 wherein said horizontal member has a cross section normal to said central axis, and the aperture in said elongated vertical member has a perimeter that is substantially the same as the cross section of the horizontal member.

4. A cross shaped marker according to claim 1 wherein the sides of said horizontal member are resilient, and said index engagement means on one of the sides of the horizontal member comprises a female portion, and the engagement means on the vertical member comprised a male portion extending from the aperture in the vertical member, so that insertion of the horizontal member through the aperture in the vertical member permits the horizontal member to slide through the aperture in the vertical member until the male portion on the vertical member engages the female portion in the horizontal member.

5. A cross shaped marker according to claim 4 wherein said male portion is of unitary construction with the vertical member.

6. A cross shaped marker according to claim 1 wherein said horizontal member is hollow and said vertical member is hollow.

7. A cross shaped marker comprising:

a hollow elongated vertical member having a major axis, ends and at least two opposing parallel planar sides separated by a distance, the sides being parallel and separated from the major axis, the major axis extending between the ends, the major axis being longer than the distance between the two opposing sides, the elongated vertical member further having an aperture extending through the elongated vertical member and between the two opposing sides, the aperture having a central axis that is normal to the major axis of the elongated vertical member, the aperture further having engagement means for securing a member inserted through the aperture;

an elongated horizontal member entirely supported by said elongated vertical member, the elongated horizontal member having sides that are spaced apart and a pair of ends, the ends of the elongated horizontal member being along a central axis and spaced apart at a distance that is greater than the distance between the sides of the elongated horizontal member, the elongated horizontal member further having a cross section normal to said central axis, the cross section being at least partially defined by the sides of the elongated horizontal member, one of the sides of the elongated horizontal member having an index engagement means for cooperating with the engagement means on the elongated vertical member, the index engagement means for cooperating with the engagement means on the elongated vertical member being at approximately mid-span along the elongated horizontal member, so that on insertion of the horizontal member through the aperture in the vertical member, the index engagement means of the horizontal member cooperates with the engagement means of the vertical member to fix the position of the horizontal member through the vertical member to form the cross shaped marker with the an elongated vertical member bisecting the elongated horizontal member.

8. A cross shaped marker according to claim 7 wherein the sides of said horizontal member are resilient, and said index engagement means on one of the sides of the horizontal member comprises a slotted aperture, and the engagement means on the vertical member comprised a male portion extending from the aperture in the vertical member, so that insertion of the horizontal member through the aperture in the vertical member causes the male portion on the vertical member to deflect the side of the horizontal member to permits the horizontal member to slide through the aperture in the vertical member until the male portion on the vertical member engages the slotted aperture in the horizontal member so that the resiliency of the sides of the horizontal member bias the slotted aperture towards the male portion.

9. A cross shaped marker according to claim 8 wherein said male portion is of unitary construction with the vertical member.

10. A cross shaped marker according to claim 9 wherein said horizontal member is hollow and said vertical member is hollow.

11. A cross shaped marker according to claim 9 wherein said horizontal member is made from an extrusion of a plastic material, and said vertical member is made from an extrusion of a plastic material.

12. A cross shaped marker according to claim 11 and further comprising a pair of end caps over the ends of said horizontal member, and an end cap over one of the ends of said vertical member.

13. A cross shaped marker comprising:

a hollow elongated vertical member having a major axis, a first end and a second end, and a generally rectangular cross section normal to the major axis, the hollow elongated vertical member having parallel planar sides, the sides being parallel and separated from the major axis, the major axis extending between the ends, the elongated vertical member further having an aperture extending through the elongated vertical member and between the two opposing sides, the aperture having a central axis that is normal to the major axis of the elongated vertical member, the apertare being closer to the first end of the vertical member than the second end of the vertical member, the aperture further having engagement means for securing a member inserted thorough the aperture;

an elongated horizontal member that is entirely supported by said elongated vertical member, the elongated horizontal member having sides that are spaced apart and a pair of ends, the ends of the elongated horizontal member being along a central axis and spaced apart at a distance that is greater than the distance between the sides of the elongated horizontal member, the elongated horizontal member further having a cross section normal to said central axis, the cross section being at least partially defined by the sides of the elongated horizontal member, one of the sides of the elongated horizontal member having an index engagement means for cooperating with the engagement means on the elongated vertical member, the index engagement means being closer to one of the ends of the horizontal member than the other end and at approximately mid-span along the elongated horizontal member, so that on insertion of the horizontal member through the aperture in the vertical member, the index engagement means of the horizontal member cooperates with the engagement means of the vertical member to fix the position of the horizontal member through the vertical member to form the cross shaped marker with the an elongated vertical member bisecting the elongated horizontal member.

14. A cross shaped marker according to claim 13 wherein the sides of said horizontal member are resilient, and said index engagement means on one of the sides of the horizontal member comprises a slotted aperture, and the engagement means on the vertical member comprised a male portion extending from the aperture in the vertical member, so that insertion of the horizontal member through the aperture in the vertical member causes the male portion on the vertical member to deflect the side of the horizontal member to permits the horizontal member to slide through the aperture in the vertical member until the male portion on the vertical member engages the slotted aperture in the horizontal member so that the resiliency of the sides of the horizontal member bias the slotted aperture towards the male portion.

15. A cross shaped marker according to claim 14 wherein said male portion is of unitary construction with the vertical member.

16. A cross shaped marker according to claim 15 wherein said horizontal member is hollow and said vertical member is hollow.

17. A cross shaped marker according to claim 16 wherein is said horizontal member is made from an extrusion of a plastic material, and said vertical member is made from an extrusion of a plastic material.

18. A cross shaped marker according to claim 17 and further comprising a pair of end caps over the ends of said horizontal member, and an end cap over one of the ends of said vertical member.

* * * * *